US007341159B2

(12) United States Patent
Nelson

(10) Patent No.: US 7,341,159 B2
(45) Date of Patent: Mar. 11, 2008

(54) SAFETY SYSTEM FOR PREVENTING FALLS

(76) Inventor: Roger Gail Nelson, 2255 N. Lakeway Cir., Wichita, KS (US) 67205

( * ) Notice: Subject to any disclaimer, the term of this patent is extended or adjusted under 35 U.S.C. 154(b) by 0 days.

(21) Appl. No.: 11/465,676

(22) Filed: Aug. 18, 2006

(65) Prior Publication Data

US 2007/0107985 A1 May 17, 2007

Related U.S. Application Data

(60) Provisional application No. 60/710,457, filed on Aug. 23, 2005.

(51) Int. Cl.
*B66C 13/44* (2006.01)

(52) U.S. Cl. ..... 212/285; 182/3; 182/18; 212/271; 340/685

(58) Field of Classification Search ..... 212/270, 212/271, 285; 340/685; 182/3, 18
See application file for complete search history.

(56) References Cited

U.S. PATENT DOCUMENTS

| | | | | |
|---|---|---|---|---|
| 4,919,283 | A * | 4/1990 | Riley et al. | 212/285 |
| 5,428,344 | A * | 6/1995 | Curry et al. | 340/539.1 |
| 5,522,472 | A * | 6/1996 | Shuman et al. | 182/3 |
| 6,265,983 | B1 * | 7/2001 | Baillargeon | 340/687 |
| 6,868,941 | B1 * | 3/2005 | Hermann | 182/3 |
| 2004/0119598 | A1 * | 6/2004 | Deimel | 340/685 |
| 2004/0173405 | A1 * | 9/2004 | Bove | 182/3 |

* cited by examiner

*Primary Examiner*—Thomas J. Brahan
(74) *Attorney, Agent, or Firm*—Grant D. Kang; Kang Intellectual Property Law, LLC

(57) ABSTRACT

A safety system for preventing crane operator injury. Two ergonomic tracks are attached on either side of the working crane. A fall transmitter is used whenever a crane operator is not on the floor. The fall transmitter has speed and travel distance governors that limit the speed and travel of certain aspects of the crane. In a further embodiment, a second fall transmitter is utilized by the second crane operator to assure that both operators are aware of and agree to any crane movement prior to commencing such movement.

23 Claims, 9 Drawing Sheets

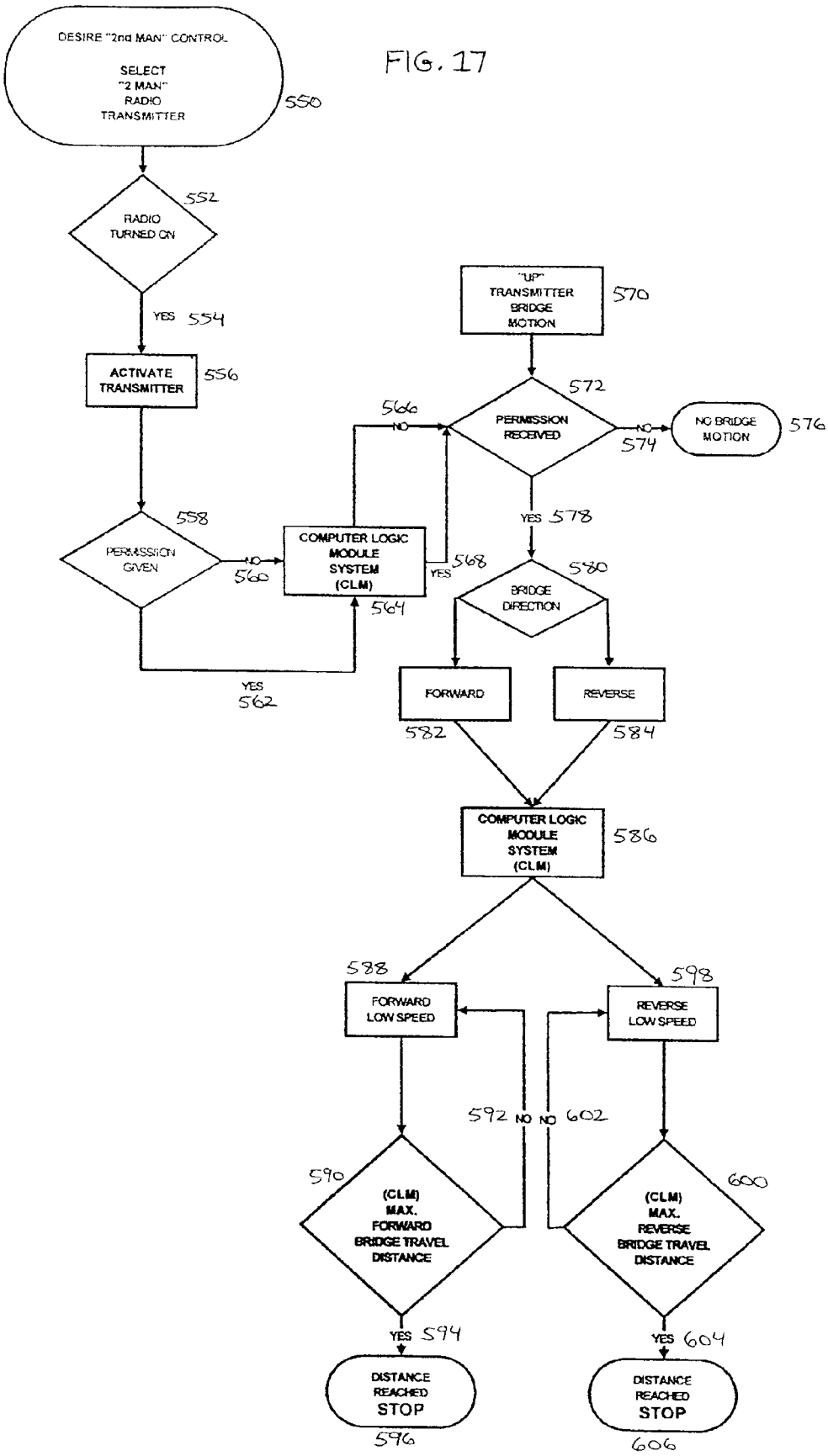
DESIRE "2nd MAN" CONTROL
SELECT "2 MAN" RADIO TRANSMITTER
550
FIG. 17
RADIO TURNED ON
552
YES 554
ACTIVATE TRANSMITTER
556
PERMISSION GIVEN
558
NO 560
YES 562
COMPUTER LOGIC MODULE SYSTEM (CLM)
564
YES 568
NO 566
"UP" TRANSMITTER BRIDGE MOTION
570
PERMISSION RECEIVED
572
NO 574
NO BRIDGE MOTION
576
YES 578
BRIDGE DIRECTION
580
FORWARD
582
REVERSE
584
COMPUTER LOGIC MODULE SYSTEM (CLM)
586
FORWARD LOW SPEED
588
REVERSE LOW SPEED
598
592 NO
NO 602
(CLM) MAX. FORWARD BRIDGE TRAVEL DISTANCE
590
(CLM) MAX. REVERSE BRIDGE TRAVEL DISTANCE
600
YES 594
DISTANCE REACHED STOP
596
YES 604
DISTANCE REACHED STOP
606

SAFETY SYSTEM FOR PREVENTING FALLS

CROSS-REFERENCE TO RELATED APPLICATIONS

This application claims priority of U.S. Provisional Patent Application No. 60/710,457, filed Aug. 23, 2005 which is herein incorporated by reference.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

The present invention relates to the safety of employees in elevated work positions and, more specifically, to vertical lifeline systems.

2. Related Art

An overhead bridge crane contained in a building runs on elevated beams or rails. There are two parallel beams or rails called runway beams. Perpendicular to the runway beams is the bridge or girder (also called the "crane"). The bridge, or "crane," is connected to the runway beams by two end trucks on each end of the bridge. The end trucks can be anywhere from five feet long for a small crane to nearly twenty feet long for a long span crane. The bridge can move in either direction along the runway beams ("North-South" will be used herein to describe this "bridge travel") via these end trucks. On the bridge is a trolley, which can move in either direction along the bridge ("East-West"). The trolley holds the working hoist, which can move Up or down ("Up-Down"); the working hoist in a bridge crane lifts and lowers the object of the work, the load. Most bridge cranes are controlled via remote control radio transmitters. The structure of bridge cranes allows 3-axis motion in the X, Y, and Z planes and thus allows full coverage of the floor to perform work.

When a crane operator doing work with an overhead bridge crane (a "working crane") is more than six or seven feet above the floor, the operator is required by Occupational Health and Safety Administration (OSHA) to use fall protection equipment. Since a considerable amount of crane work is elevated, or "up," elevated crane operators, or "fall operators," generally wear fall protection equipment, such as a personal fall arrest system. However, many fall operators use no protection, which is a direct violation of OSHA. When protection is used, methods are often cumbersome and restrictive, and are generally a hassle.

In one type of personal fall arrest system, a Vertical Lifeline System, a fall operator is attached to an anchorage overhead. The system consists of a fixed anchorage, a self-retracting lifeline (SRL), and a body harness. When the fall operator moves, the fixed anchorage is no longer directly above the fall operator, creating an angle. This leads to a pendulum effect if a fall operator should fall, which is not ideal under the American National Standards Institute (ANSI) codes regarding verticality of fall restrictions.

A second fall arrest system, the Monorail Beam, consists of a beam located under the runway beam that swings out parallel to the runway. This method is problematic because the beam is usually located where the crane needs to work. In addition, the SRLs used move trolleys with considerable rolling resistance. Consequently, when a fall operator needs to move, that fall operator has to tug at the SRL to move the trolley along the beam, which requires significant effort. Moreover, the Monorail Beam system is quite expensive and often requires a hydraulic power supply to move it.

A third and more commonly used fall arrest system is comprised of a second overhead bridge crane (a second bridge with a light capacity), or "fall crane." This fall crane is placed on the same runway beams as the working crane. Thus, the working crane and the fall crane are parallel and adjacent to each other. An anti-collision system on the working crane is needed so that the working crane and the fall crane do not accidentally collide. One or two trolleys are placed on the fall crane bridge; an SRL is connected to each trolley, and a body harness is attached to each SRL. By installing either one or two trolleys, the fall crane can be designed to support either one or two fall operators. There are various problems with this fall protection method, as described below:

a) It is not cost-efficient to buy and maintain a second crane (the fall crane) that does no work. Additionally, it is less efficient and more costly to have two cranes in operation (the working crane and the fall crane) instead of one.

b) Two transmitters are needed, one for the working crane and a second for the fall crane. This results in two transmitters to maintain and control instead of one.

c) Since the fall crane is always on one side or the other of the working crane, the fall crane is often in the way of the working crane. If the working crane needs to be moved, either the fall crane must first be moved out of the way, or the fall crane must be moved along with the working crane. This extra step is inefficient and may require a second crane operator in addition to the operator for the working crane.

d) The working crane and the fall crane often need to be positioned close to each other to get work done. In order to position the two cranes close to one another, an anti-collision override on the working crane must be activated. This requires the pushing of two buttons instead of one: the anti-collision override button and the normal move button.

e) Since the fall crane is always on one side or the other of the working crane, the two cranes are always separated; the greater the length of the end trucks, the greater the separation between the two cranes. As a result of this separation, a fall operator positioned by the working crane is attached to a lifeline that is not directly vertical. The angle that is created leads to a pendulum effect if a fall occurs, which is not ideal under the ANSI codes regarding verticality of fall restrictions.

f) If the fall crane is designed to support two fall operators (if there are two SRLs attached to the fall crane), the fall operators must work side by side on the fall crane and cannot "pass" each other (East-West) along the fall crane to work in each other's location. This restricts a fall operator's ability to get work done. The side-by-side positioning of two fall operators also creates an angle problem, leading to a pendulum effect if a fall occurs.

g) The trolleys have significant rolling resistance. As a result, when a fall operator wants to move East-West, that operator has to tug at the SRL to move the trolley along the bridge, which requires significant effort.

h) The working crane has unrestricted movement at all speeds. As a result, a fall operator can unintentionally drag himself (and another fall operator if there are two) off of the equipment.

i) When there are two operators "up," there is the risk that one of the fall operators will not be in a position where he is ready for the other fall operator to move the crane.

For the foregoing reasons, the second overhead bridge crane method is not ideal.

SUMMARY OF THE INVENTION

A fall protection system is needed in which a working crane can be safely operated through restrictions on the working crane's speed and travel distance. At the same time, the fall operator protected by this system must be permitted to do work with as few restrictions as possible. The present invention is an improved fall protection system for crane operators in a working crane environment.

In the present invention, the fall system is mounted onto a working crane. The fall system will work with top running single girder working cranes, top running double girder working cranes, and under running single girder working cranes. If the existing working crane is not new, the working crane must be modernized to accommodate the fall system.

The working crane has two main runway beams running in one direction (designated North-South for clarity) and a bridge (and girders) running in a second direction (designated East-West for clarity) between the two runway beams. End trucks attached to both sides of the bridge are connected to the main runway beams and allow North-South bridge travel to occur. The present invention can be used for bridge travel controls that are two speeds, three speeds, four speeds, five speeds, and infinitely Variable Speed Controlled (VFD).

The fall system includes ergonomic tracks running in the second direction (designated East-West for ease of reference), which are attached on either side of the working crane. On a double girder working crane, the tracks are attached to each girder. On a single girder working crane, the tracks are attached to structural beams on either side of the girder (bridge).

Track supports running in the North-South direction are fixed to and run perpendicular to the two ergonomic tracks. A trolley runs along each track in the East-West direction. A self-retracting lifeline (SRL) is attached to each trolley; a body harness (not included in the present invention) is attached to each SRL. This setup provides fall protection for two fall operators, one on each side of the working crane. If there are two fall operators instead of one, each of the two fall operators is attached to his own track (since there are two tracks).

The two ergonomic tracks and multiple track supports form one unit that has the capability to move as a whole in the North-South direction; the unit does not have the capability to move in the East-West direction.

When the working crane needs to be moved to perform work, a fall operator generally moves with the working crane in order to remain close to the work being done. In the present invention, a fall operator has the capability to move his fall restriction with him in both the North-South and East-West directions. When the working crane moves North-South, a fall operator can move himself by moving his SRL along the ergonomic track in the North-South direction. When the working crane moves East-West, the unit comprised of the tracks and track supports moves East-West along with the working crane; thus, the fall operator does not take any action to move himself since he moves with the unit.

After work has been completed, a fall operator disconnects the SRL from his body harness and climbs down.

While operated from the floor (when there are no operators "up" and floor operators are thus operating the working crane), a floor transmitter is used. The floor transmitter can be in the form of a handheld device or consist or two or three joysticks. In order to activate the floor transmitter to move the working crane via floor mode, a master key is inserted into the transmitter. A function (hoist motion, trolley motion, or bridge motion) and a direction (up or down for the hoist, forward or reverse for the trolley, and forward or reverse for the bridge) are then selected. The crane can then be operated as a normal working crane at all speeds (stop, low, or high).

When operated from above the floor (when there are operators "up" and fall operators are thus operating the working crane), a fall mode is engaged, and a fall operator changes to a different radio transmitter called a fall transmitter. The fall transmitter is in the form of a handheld device. In order to use this fall transmitter to move the working crane, the master key is removed from the floor transmitter (thereby deactivating the floor transmitter) and is inserted into the fall transmitter (thereby activating the fall transmitter). When this fall transmitter is activated, a novel Safety Radio Interface System (SRIS) is also activated.

The SRIS consists of the floor transmitter (of the form desired), a handheld fall transmitter, and a Control Logic Module System (CLM); the SRIS may also include a safety fall transmitter for a two-man setup if so desired.

Once the fall transmitter and SRIS are activated, a function (hoist motion, trolley motion, or bridge motion) and a direction (up or down for the hoist, forward or reverse for the trolley, and forward or reverse for the bridge) are then selected.

SRIS imposes various restrictions on mobility. There are no restrictions on the Up-Down movement of the hoist; thus, the hoist can move at the following speeds: stop, low, and high. The trolley (moving East-West along the bridge) can be operated at stop or low speeds only; high speed is prevented by the system.

SRIS imposes two restrictions upon bridge movement via a computer logic module system (CLM). First, the bridge (moving North-South) can be operated at stop or low speeds only. Additionally, the CLM controls the travel distance of the bridge: the bridge can only travel a pre-designated maximum distance (or "range") in either direction. This distance cannot be altered by the fall operator. A fall operator has the ability to move the bridge back and forth (North-South) as many times as the operator chooses within the pre-designated range. When the maximum travel distance is reached, the CLM causes the bridge to stop; the bridge cannot be moved any further in the same direction but can be moved back in the opposite direction within the maximum travel distance.

In an alternative embodiment, called a two-man safety control system, both fall operators carry radio transmitters. The first fall operator has a main fall transmitter in fall mode. The second fall transmitter has a safety fall transmitter that is activated via the pressing and holding of a push button. There are two steps required in order to activate the main fall transmitter and allow the first fall transmitter to move the working crane. First, the master key must be inserted into the main fall transmitter (as described above). Second, the second fall operator must give permission (by activating the safety fall transmitter) to the first fall operator to move the crane. Only then can the first fall operator move the working crane. Movement of the crane by the first fall transmitter is restricted to the fall mode (as described above).

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

FIG. 17 is a flow diagram illustrating the method by which the working crane supporting an embodiment of the present invention is operated from above the floor when there are two fall operators, including the activation of the system, the operation of the working hoist, trolley, and bridge, and the restrictions placed upon the system by the Control Logic Module System.

DETAILED DESCRIPTION OF THE PREFERRED EMBODIMENTS

Hereinafter, preferred embodiments of the present invention will be described with references to the accompanying drawings. The description of the embodiments is merely exemplary in nature and is in no way intended to limit the invention, its application, or its uses.

Advantageously, in the preferred invention the fall system is mounted onto the working crane. Such a setup results in no need for a separate fall crane that does no work and that gets in the way of the working crane. Moreover, the same transmitter used to operate the working crane is used to operate the fall system, which results in one less transmitter to maintain and control. Furthermore, because there is only one crane, there is no need for a fall operator to push two buttons to move a working crane and a fall crane close to each other to do work; fewer required steps leads to increased work efficiency.

Figure 1:
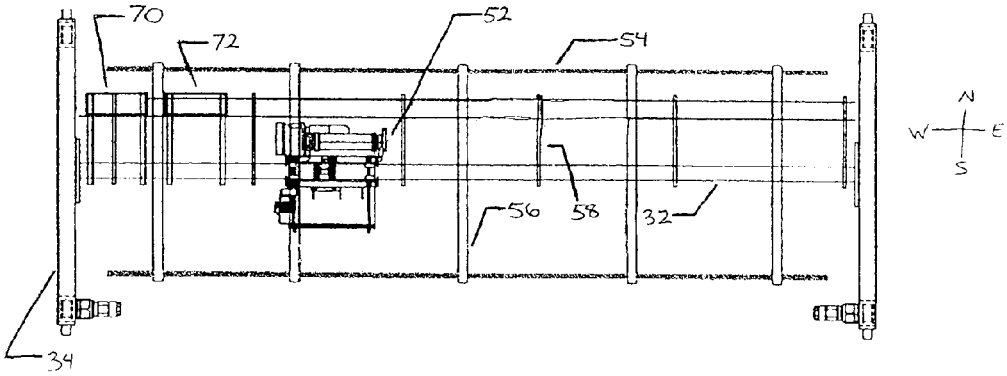
FIG. 1 is a plan view from above of an embodiment of the present invention using a top running single girder working crane.
Figure 2:
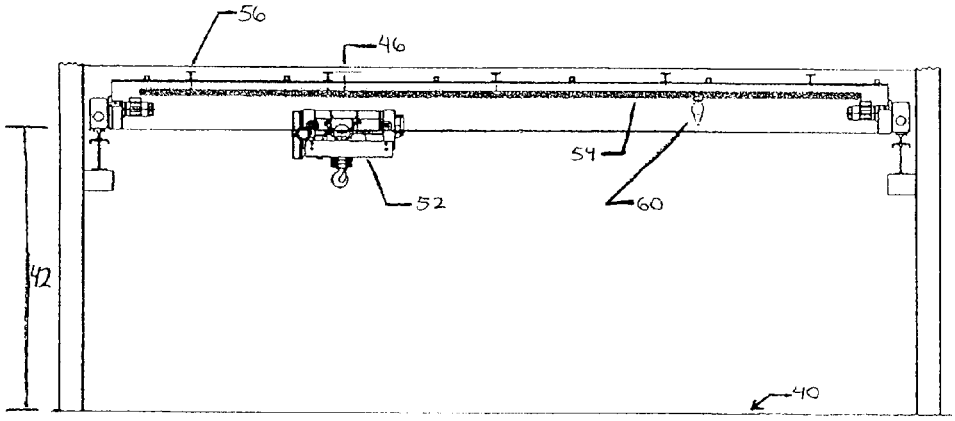
FIG. 2 is an elevation view from the side of an embodiment of the present invention using a top running single girder working crane.
Figure 3:
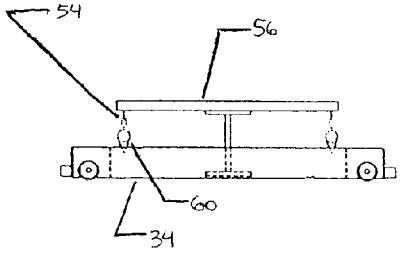
FIG. 3 is an end view of an embodiment of the present invention using a top running single girder working crane.
Figure 4:
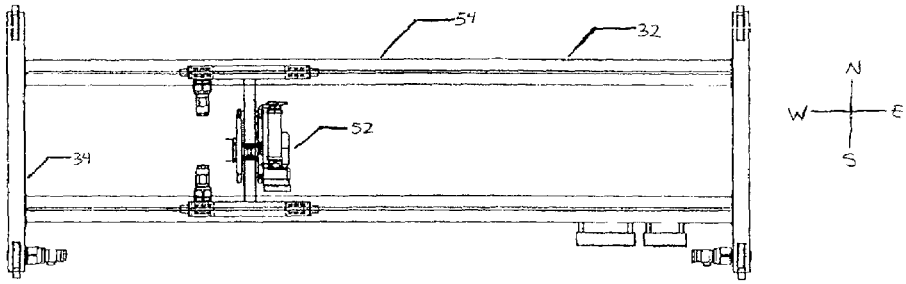
FIG. 4 is a plan view from above of an embodiment of the present invention using a top running double girder working crane with a lower girder flange.
Figure 5:
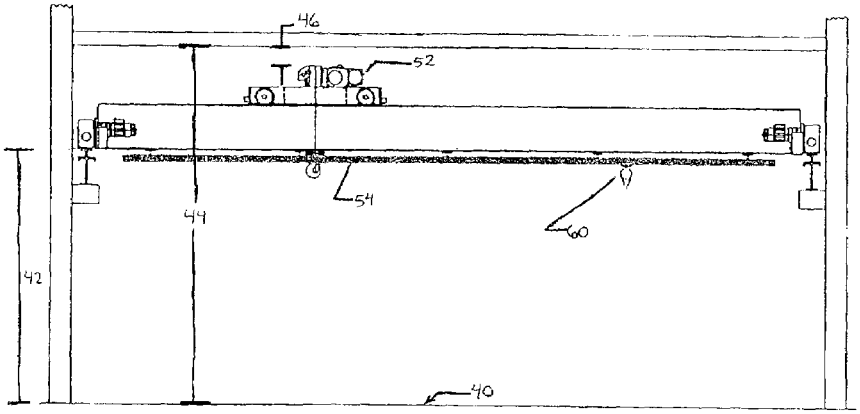
FIG. 5 is an elevation view from the side of an embodiment of the present invention using a top running double girder working crane with a lower girder flange.
Figure 6:
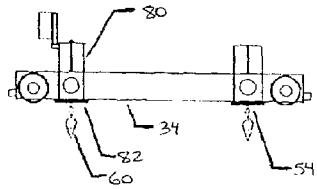
FIG. 6 is an end view of an embodiment of the present invention using a top running double girder working crane with a lower girder flange.
Figure 7:
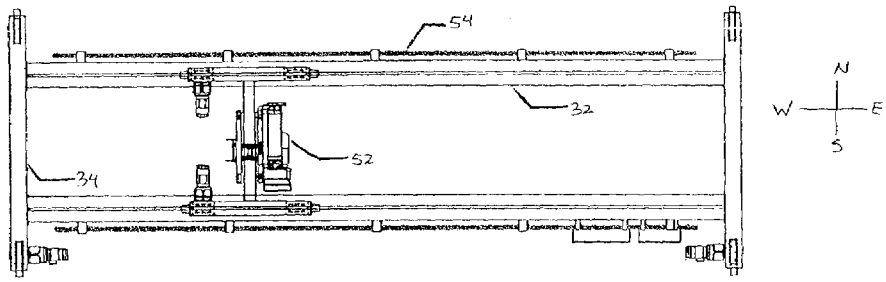
FIG. 7 is a plan view from above of an embodiment of the present invention using a top running double girder working crane with no lower girder flange.
Figure 8:
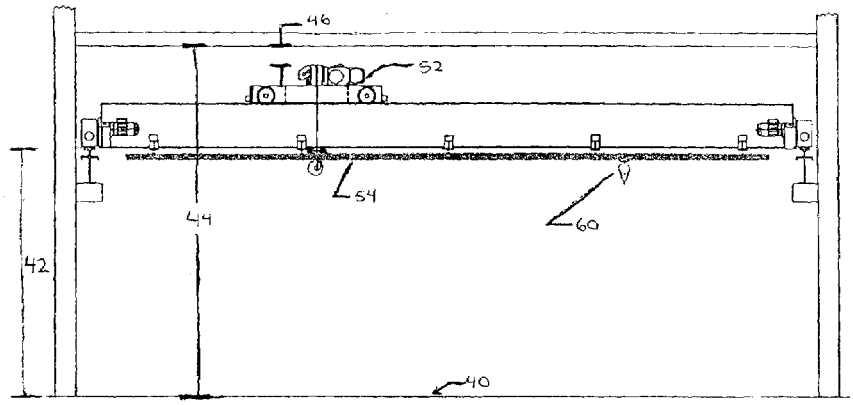
FIG. 8 is an elevation view from the side of an embodiment of the present invention using a top running double girder crane with no lower girder flange.
Figure 9:
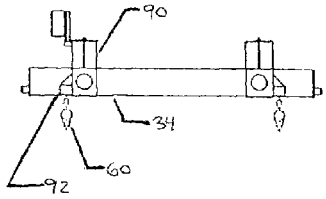
FIG. 9 is an end view of an embodiment of the present invention using a top running double girder working crane with no lower girder flange.
Figure 10:
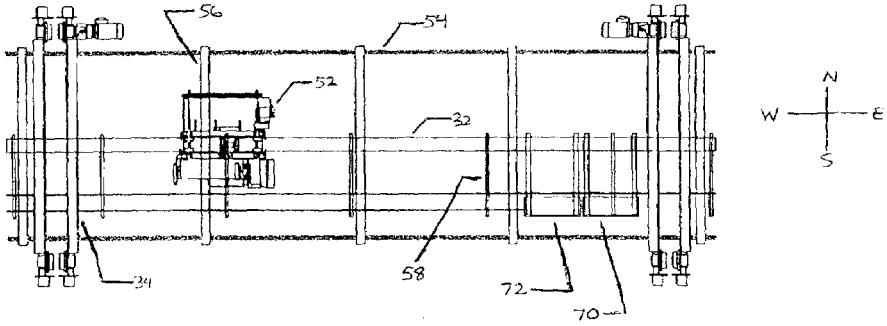
FIG. 10 is a plan view from above of an embodiment of the present invention using an under running single girder working crane.
Figure 11:
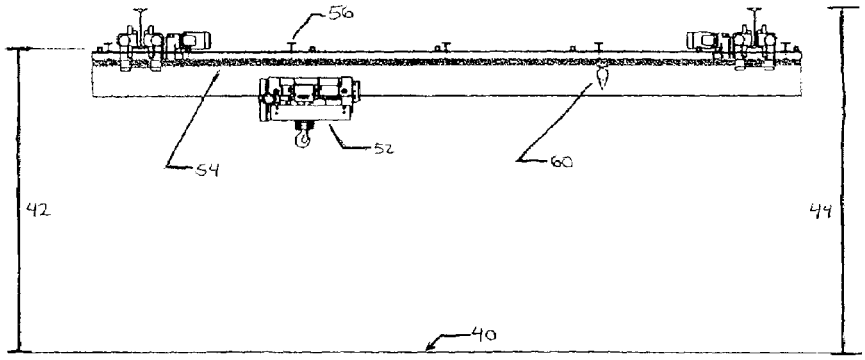
FIG. 11 is an elevation view from the side of an embodiment of the present invention using an under running single girder working crane.
Figure 12:
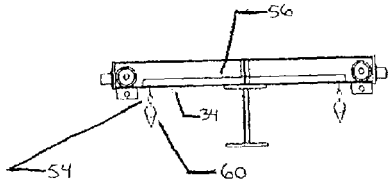
FIG. 12 is an end view of an embodiment of the present invention using an under running single girder working crane.

There are four preferred embodiments of the present invention due to the fact that the fall system can be incorporated into multiple types of working cranes. The first preferred embodiment entails the use of the fall system with a top running single girder working crane, as shown in FIGS. 1, 2, and 3. The second preferred embodiment entails the use of the fall system with a top running double girder working crane with a lower girder flange, as shown in FIGS. 4, 5, and 6. The third preferred embodiment entails the use of the fall system with a top running double girder working crane without a lower girder flange, as shown in FIGS. 7, 8, and 9. The fourth preferred embodiment entails the use of the fall system with an under running single girder working crane, as shown in FIGS. 10, 11, and 12.

The working crane used in all four of the preferred embodiments contains common elements. First, a bridge is attached to either one or two girders 32. Additionally, end trucks 34 are attached on both sides of the bridge; these end trucks connect the bridge to the runway beams and allow bridge travel along the runways.

In all four of the preferred embodiments, the working crane span is adapted to the preference of the customer and to the physical dimensions of the work area. The preferred type of hoist 52 on the working crane is a wire rope or an electric chain hoist. The preferred source voltage is 230/3/60 or 460/3/60. The preferred control voltage is 115/1/60.

In the accompanying drawings illustrating the structures of the four preferred embodiments (FIGS. 1, 2, 3, 4, 5, 6, 7, 8, 9, 10, 11, 12), 40 denotes floor level generally, 42 denotes runway height, 44 denotes clear height, and 46 denotes the preferred three-inch minimum clearance between. In all end views of the preferred embodiments (FIGS. 3, 6, 9, 12), the working hoist 52 is not shown for clarity.

In all four of the preferred embodiments, the fall system consists of ergonomic tracks 54 attached on either side of the working crane; these tracks 54 run in the East-West direction. Additionally, the fall system contains track supports 56 fixed to the two ergonomic tracks 54; these track supports 56 run in the North-South direction. Sliding control trolley conductors 58 are also utilized. A trolley runs along each track 54 in the East-West direction. The two tracks 54 and multiple track supports 56 form one unit that has the capability to move as a whole in the North-South direction; the unit does not have the capability to move in the East- West direction. An SRL 60 is attached to each trolley; a body harness (not included in the present invention) is attached to each SRL 60.

The first preferred embodiment (utilizing a top running single girder crane, as shown in FIGS. 1, 2, and 3) is distinct from other preferred embodiments in that, because there is only one girder 32, the ergonomic tracks 54 are attached to structural beams on either side of the girder 32.

The second preferred embodiment (utilizing a top running double girder working crane with a lower girder flange, as shown in FIGS. 4, 5, and 6) is distinct from other preferred embodiments in the following ways. First, because there are two girders 32, each track 54 is attached to the underside 82 of a girder 32. Second, this embodiment utilizes a structural beam or fabricated box beam with lower flange 80.

The third preferred embodiment (utilizing a top running double girder working crane without a lower girder flange, as shown in FIGS. 7, 8, and 9) is distinct from other preferred embodiments in the following ways. First, because there are two girders 32, each track 54 is attached to the underside 82 of a girder 32. Second, it utilizes a fabricated box beam with no lower flange 90, as well as a fabricated bracket welded to a girder web plate 92.

The fourth preferred embodiment (utilizing an under running single girder working crane, as shown in FIGS. 10, 11, and 12) is distinct from other preferred embodiments in that, because there is only one girder 32, the tracks 54 are attached to structural beams on either side of the girder 32.

Figure 13:
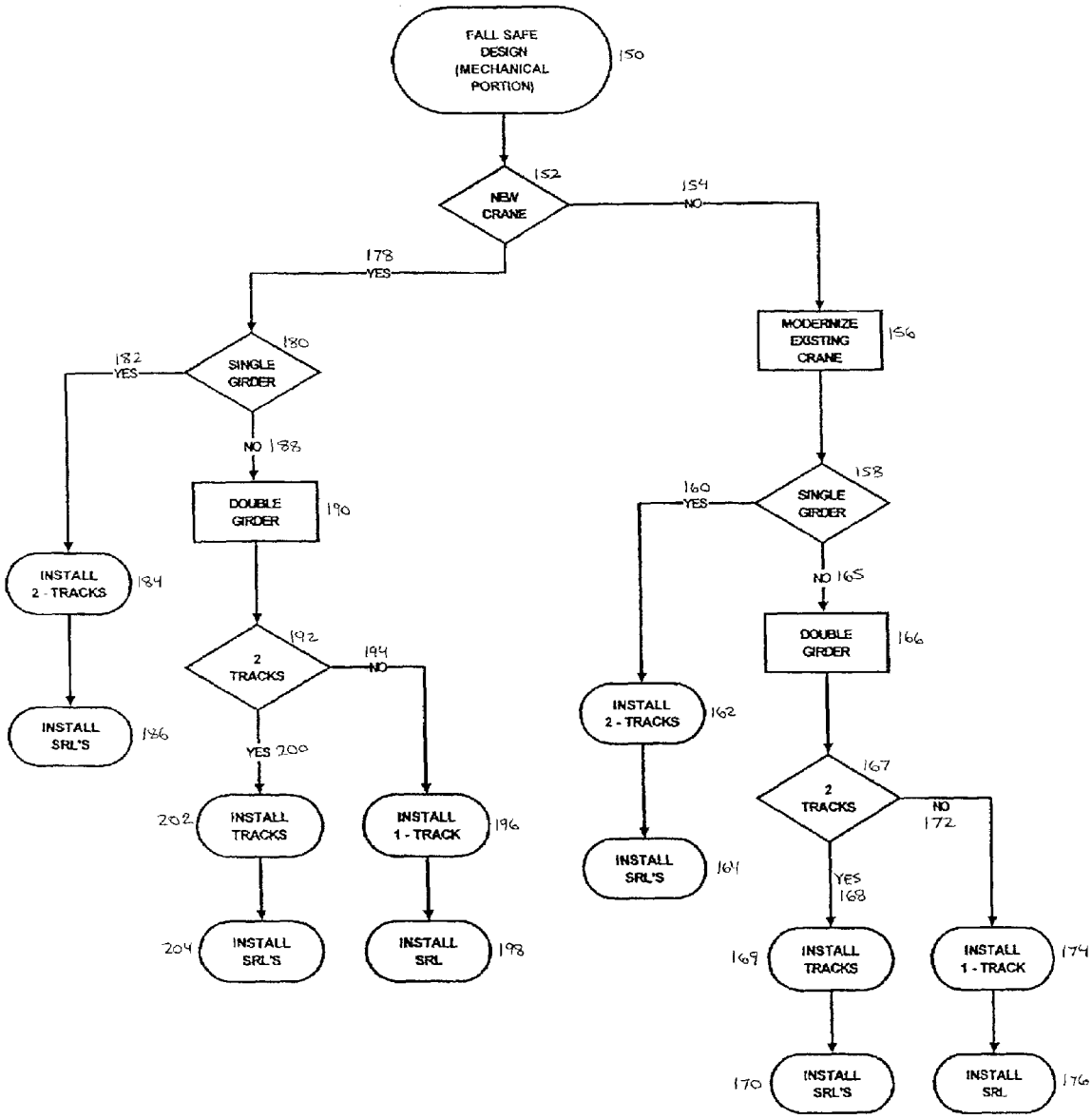
FIG. 13 is a flow diagram illustrating the mechanical setup of an embodiment of the present invention, including the methods by which working cranes are prepared for the fall system.

FIG. 13 illustrates the mechanical setup of the fall system 150. If the working crane in place is an already-existing, older crane 154, the working crane must be modernized 156 to support the fall system. If the modernized working crane is a single girder crane 158, 160, two ergonomic tracks 54 must be installed 162, and self-retracting lifelines (SRLs) must then be installed 164. If the modernized working crane is a double girder crane 165, 166, tracks must be installed as follows. If only one track is desired (if there will only be one fall operator) 172, one ergonomic track 54 must be installed 174, and one SRL 60 must then be installed 176. If two tracks are desired (if there will be two fall operators) 167, 168, two ergonomic tracks 54 must be installed 169, and two SRLs 60 must then be installed 170.

If the working crane in place is a new crane with no need for modernization to support the fall system 152, 178, the following installations must occur. If the working crane is a single girder crane 180, 182, two ergonomic tracks 54 must be installed 184, and self-retracting lifelines (SRLs) must then be installed 186. If the working crane is a double girder crane, 188, 190, ergonomic tracks 54 must be installed as follows. If only one track is desired (if there will only be one fall operator) 194, one ergonomic track 54 must be installed 196, and one SRL 60 must then be installed 198. If two tracks are desired (if there will be two fall operators) 192, 200, two ergonomic tracks 54 must be installed 202, and two SRLs 60 must then be installed 204.

Figure 14:
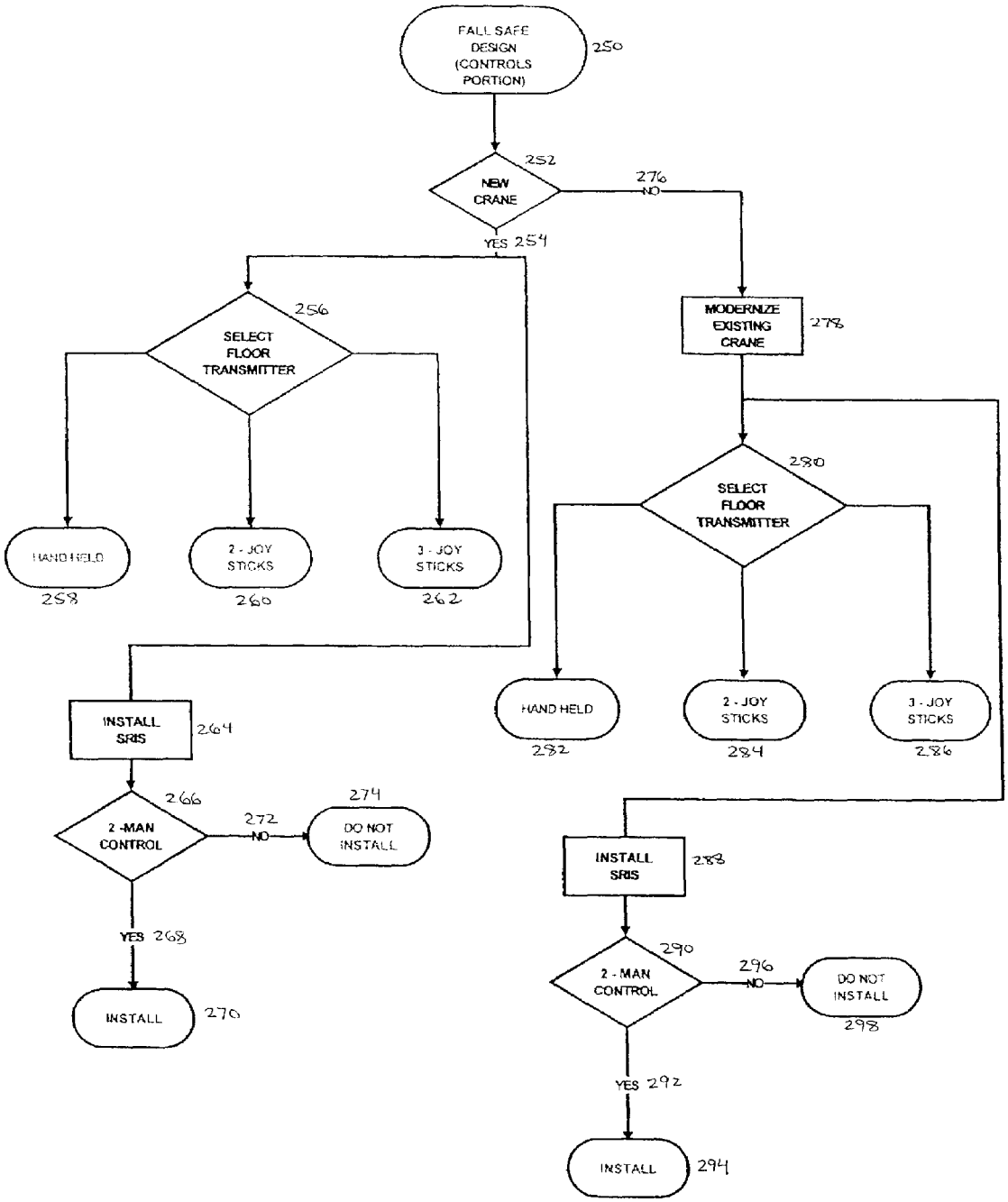
FIG. 14 is a flow diagram illustrating the controls setup of an embodiment of the present invention, including the possible types of floor transmitters and the methods by which the Safety Radio Interface System is installed.

FIG. 14 illustrates the controls setup of the fall system 2. If the working crane is new 252, 254, a floor transmitter must be selected 256. There are three options for a floor transmitter: a hand held version 258, two joy sticks 260, or three joy sticks 262. Additionally, the Safety Radio Interface System (SRIS) must be installed 264. The SRIS consists of the floor transmitter (of the form desired), a handheld fall transmitter, and a Control Logic Module System (CLM); the SRIS may also include a safety fall transmitter for a two-man setup if so desired. If a two-man control setup is desired 266, 268, such a system must then be installed 270 (if not needed 272, there is no need for an installation 274)

If the working crane is a modernized version of an existing working crane 276, 278, a type of floor transmitter must also be selected 280. As with a new working crane, there are three options for a floor transmitter with a modernized working crane: a hand held version 282, two joy sticks 284, or three joy sticks 286. Additionally, the SRIS, containing the same elements as described above, must be installed 288. If a two-man control setup is desired 290, 292, such a system must then be installed 194 (if not needed 296, there is no need for an installation 298).

Movement of the fall operator is simplistic and efficient in all four of the preferred embodiments. A fall operator has the capability to move his fall restriction with him in both the North-South and the East-West directions. As a result, the fall restriction is always directly above the fall operator, and there is thus no pendulum effect in the case of a fall.

When the working crane moves East-West, a fall operator can remain positioned by the working crane by moving his SRL 60 along his ergonomic track 54 in the East-West direction. Rolling resistance of the trolley is minimized due to the ergonomic nature of the tracks 54. Consequently, a fall operator does not have to tug at his SRL 60 to move the trolley, resulting in freer movement of the trolley.

When the working crane moves North-South, the unit comprised of the tracks 54 and track supports 56 moves North-South with the working crane; the fall operator and his fall restriction thus stay with the working crane without any action on the fall operator's part. Increased efficiency and ease result from this automatic movement of the fall system.

The setup of all preferred embodiments allows fall protection for two fall operators, one on each side of the working crane. This setup is advantageous because two fall operators no longer have to work side by side. Two fall operators can move with full freedom along the tracks 54 (East-West) while both attached to the system. Consequently, there are fewer restrictions on a fall operator's ability to get work done. Furthermore, having only one fall operator on each track 54 eliminates the angle problem of having two workers attached side by side. Thus, no pendulum effect is created in the case of a fall, which is ideal under the American National Standards Institute (ANSI) codes regarding verticality of fall restrictions.

Operation of the present invention is safely restricted and efficient. In addition to the basic structural elements (ergonomic tracks, track supports, sliding control trolley conductors, trolleys, and SRLs), all four preferred embodiments include a crane control panel 70 and an SRIS 72. The SRIS 72 imposes various restrictions on mobility when the working crane is operated by fall operators (is in fall mode) but imposes no restrictions when the working crane is operated by floor transmitters. Consequently, the working crane is a fully functional crane (can be operated at all speeds) for floor operators and is a fully functional but safely restricted crane for fall operators. SRIS-imposed restrictions include maximum travel distance of the bridge and maximum speed of the bridge and the trolley; these restrictions are controlled via a computer logic module system (CLM)).

Advantageously, the speed restrictions and bridge travel distance restrictions greatly diminish the chance that a fall operator will unintentionally drag himself (or another fall operator if there are two) off of the equipment. Additionally, due to the travel distance restrictions, there is no need for an anti-collision system to prevent collisions between the working crane and the ergonomic tracks 54. (If additional, neighboring cranes are in the area of the working crane, however, it is preferred that an anti-collision system be installed on the neighboring crane for the safety of the fall operator.)

Figure 15:
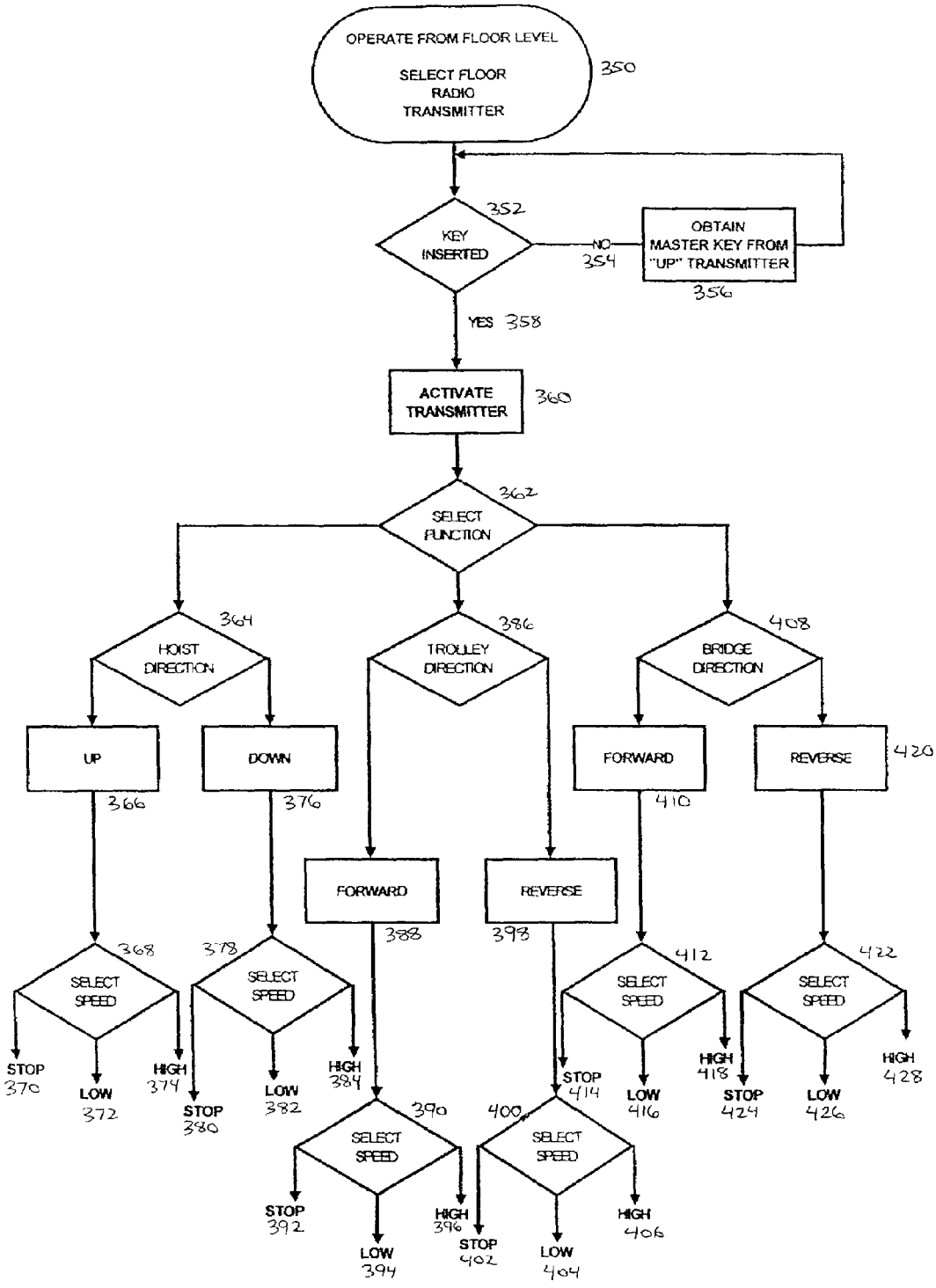
FIG. 15 is a flow diagram illustrating the method by which the working crane supporting an embodiment of the present invention is operated from the floor when there is one fall operator, including the activation of the system and the operation of the working hoist, trolley, and bridge.

FIG. 15 illustrates how the working crane is operated from the floor (when there are no operators "up" and floor operators are thus operating the working crane) 350. There are no SRIS-imposed restrictions on mobility when floor operators are operating the working crane. In order to operate the working crane in this arrangement, a floor radio transmitter is first selected 350. A master key is then inserted into the floor transmitter 352. If a master key is currently in the fall transmitter 354, the master key must be removed from the fall transmitter and taken down to the floor level 356, and then inserted into the floor transmitter 352. Once the master key is inserted into the floor transmitter 358, the floor transmitter is activated 360.

Next, a function is selected by the floor operator 362. If hoist motion is selected 364, the floor operator can select upward motion 366 or downward motion 376. If upward motion is selected 366, the floor operator can select one of the following speeds 368: stop 370, low 372, or high 374. Similarly, if downward motion is selected 378, the floor operator can select one of the following speeds 378: stop 380, low 382, or high 384.

If trolley motion is selected 386, the floor operator can select forward motion 388 or reverse motion 398. If forward motion is selected 388, the floor operator can select one of the following speeds 390: stop 392, low 394, or high 396. Similarly, if reverse motion is selected 398, the floor operator can select one of the following speeds 400: stop 402, low 404, or high 406.

If bridge motion 408 is selected by the floor operator, the floor operator can then select forward motion 410 or reverse motion 420. If forward motion is selected 410, the floor operator can select one of the following speeds 412: stop 414, low 416, or high 418. Similarly, if reverse motion is selected 420, the floor operator can select one of the following speeds 422: stop 424, low 426, or high 428.

Figure 16:
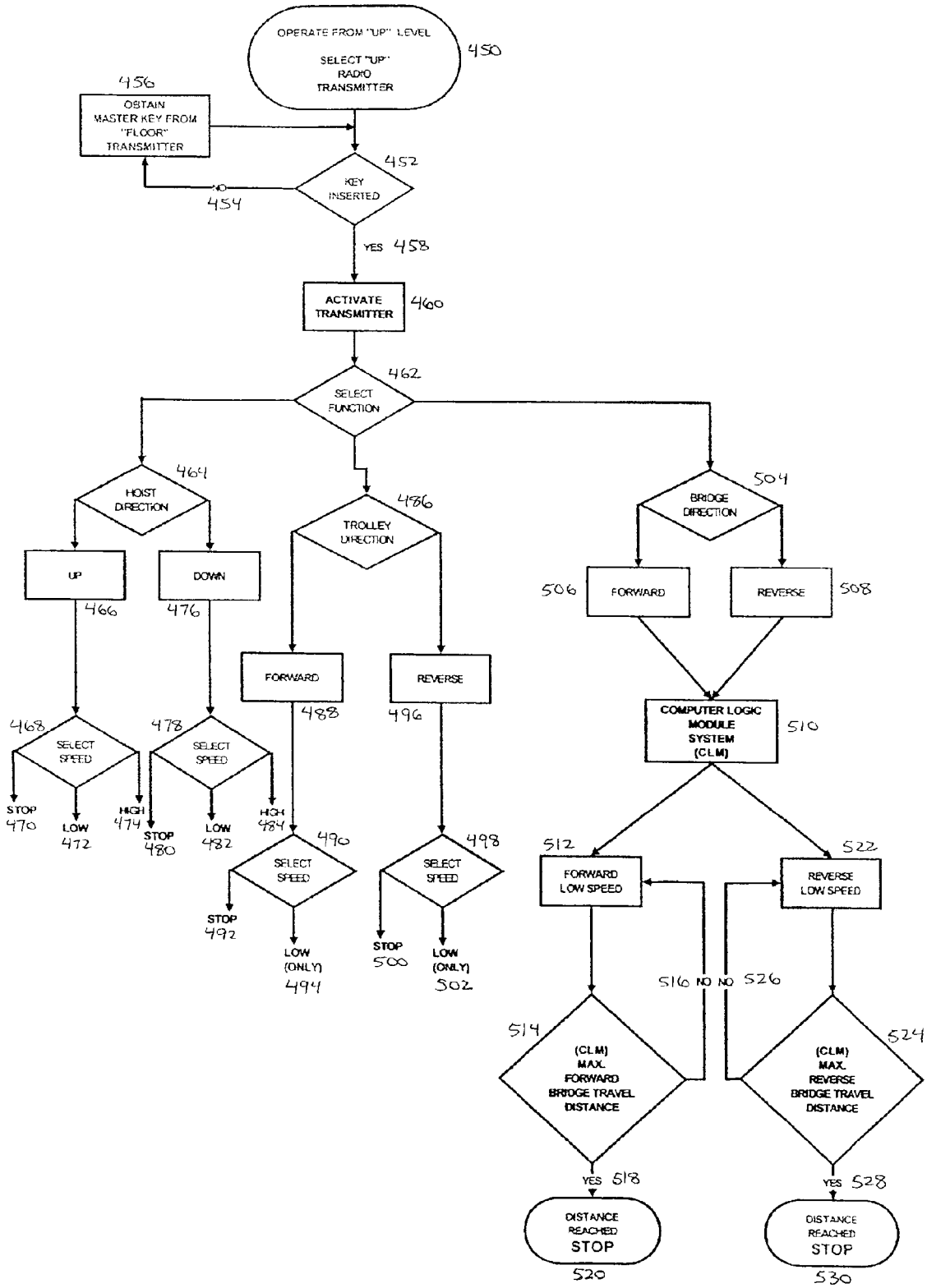
FIG. 16 is a flow diagram illustrating the method by which the working crane supporting an embodiment of the present invention is operated from above the floor when there is one fall operator, including the activation of the system, the operation of the working hoist, trolley, and bridge, and the restrictions placed upon the system by the Control Logic Module System.

FIG. 16 illustrates how the working crane is operated from above the floor by one operator (when there is one operator "up" and one fall operator is thus operating the working crane). There are SRIS-imposed restrictions on mobility when one fall operator is operating the working crane. In order to operate the working crane in this arrangement a fall radio transmitter is first selected 4. A master key is then inserted into the fall transmitter 454. If a master key is currently in the floor transmitter 454, the master key must be removed from the floor transmitter and taken up 456, and then inserted into the fall transmitter 454. Once the master key is inserted into the fall transmitter 458, the fall transmitter is activated 460.

Next, a function is selected by the fall operator 462. If hoist motion is selected 464, the floor operator can select upward motion 466 or downward motion 476. If upward motion is selected 466, the floor operator can select one of the following speeds 468: stop 470, low 472, or high 474. Similarly, if downward motion is selected 476, the floor operator can select one of the following speeds 478: stop 480, low 482, or high 484 (there are no SRIS-imposed restrictions on the Up-Down movement of the hoist).

If trolley motion is selected 486, the floor operator can select forward motion 488 or reverse motion 496. If forward motion is selected 488, the floor operator can select one of the following speeds 490: stop 492 or low 494 only (high speed is not allowed by the system). Similarly, if reverse motion is selected 496, the floor operator can select one of the following speeds 498: stop 500 or low 502 only (high speed is not allowed).

If bridge motion is selected by the fall operator 504, the fall operator can then select forward motion 506 or reverse motion 508. Once the motion direction has been selected, the CLM governs the speed 510, allowing the trolley to move either at forward low speed 512 or reverse low speed 522 only (high speed is not allowed by the system).

SRIS imposes maximum bridge travel distance restrictions via CLM. The bridge can only travel a pre-designated maximum distance (or "range") in either direction. This distance cannot be altered by the fall operator. A fall operator has the ability to move the bridge back and forth (North-South) as many times as the fall operator chooses within the pre-designated range. When the maximum travel distance is reached, the CLM causes the bridge to stop; the bridge cannot be moved any further in the same direction but can be moved back in the opposite direction within the maximum travel distance.

This process operates as follows. If the forward direction for bridge motion has been chosen 506, the CLM determines whether the bridge has already traveled the maximum forward distance 514. If the bridge has already traveled the maximum forward distance 518, the bridge stops 520. If it has not 516, the bridge continues at forward slow speed 512 until the CLM judges that maximum distance has been reached 514, upon which the bridge stops 520.

If the reverse direction for bridge motion has been chosen 508, the CLM determines whether the bridge has already traveled the maximum reverse distance 524. If the bridge has already traveled the maximum reverse distance 528, the bridge stops 530. If it has not 526, the bridge continues at reverse slow speed 522 until the CLM judges that maximum distance has been reached 524, upon which the bridge stops 530.

FIG. 17 illustrates how the working crane is operated from above the floor when there are two operators "up" 5. This alternative embodiment, called a two-man safety control system, can be used with any of the four preferred embodiments described above. In this alternative embodiment, both fall operators carry radio transmitters. The first fall operator has a main fall transmitter in fall mode. The second fall transmitter has a safety fall transmitter that is activated via the pressing and holding of a push button.

In order to operate the working crane in this arrangement, a two-man radio transmitter is first selected 550 and then turned on 552 by the insertion of the master key into the transmitter; once the radio has been turned on 554, the transmitter has been activated 556. Next, the second fall operator must give permission (by activating the safety fall transmitter) to the first fall operator to move the crane 558. This permission indicates that the second operator is clear, ready, and safe for the first operator to take control and move the working crane. Such a safeguard assures that both fall operators are aware of and agree to any working crane movement before the movement commences. The CLM processes 564 a "yes" permission signal 562, 568 or a "no" permission signal 560, 566.

If the first fall transmitter has selected bridge motion 570, and if the first fall operator has received the second fall operator's permission 572, 578, the first fall operator has the ability to move the working crane via bridge motion 580. If the first fall transmitter has selected bridge motion 570, and if the first fall operator has not received the second fall operator's permission 572, 574, the first fall operator does not have the ability to move the working crane via bridge motion 576.

Movement of the crane by the first fall operator in this two-man safety control system is restricted to the fall mode (and thus subject to speed and travel distance limitations). If bridge motion is selected by the first fall operator 570, 580, the first fall operator can then select forward motion 582 or reverse motion 584. Once the motion direction has been selected, the CLM governs the speed 586, allowing the trolley to move either at forward low speed 588 or reverse low speed 598 only (high speed is not allowed by the system).

If the forward direction for bridge motion has been chosen 582 by the first fall operator, the CLM determines whether the bridge has already traveled the maximum forward distance 590. If the bridge has already traveled the maximum forward distance 594, the bridge stops 596. If it has not 592, the bridge continues at forward slow speed 588 until the CLM judges that maximum distance has been reached 590, upon which the bridge stops 596.

If the reverse direction for bridge motion has been chosen 584 by the first fall operator, the CLM determines whether the bridge has already traveled the maximum reverse distance 600. If the bridge has already traveled the maximum reverse distance 604, the bridge stops 606. If it has not 602, the bridge continues at reverse slow speed 598 until the CLM judges that maximum distance has been reached 600, upon which the bridge stops 606. In this way, one alternative embodiment of the present invention provides a safely restricted and efficient means for the working crane to be moved when two operators are "up."

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, the directional terms "North-South" for one orientation and "East-West" for another orientation are illustrative and not literally North-South and East-West. Thus, the breadth and scope of the present invention should not be limited by any of the above-described exemplary embodiments but should be defined only in accordance with the following claims appended hereto and their equivalents.

What is claimed is:

1. A safety system for preventing falling injury from a working crane, comprising:

a hoist;

two tracks disposed on either side of said hoist;

a trolley connected to each of said tracks;

a lifeline connected to each of said trolleys;

a floor transmitter;

a first fall transmitter configured to move said working crane and to restrict said working crane's speed and travel; and a key; and wherein said floor transmitter is activated by inserting said key into said floor transmitter; and wherein said first fall transmitter is activated by removing said key from said floor transmitter and inserting said key into said first fall transmitter.

2. A safety system for preventing falling injury from a working crane according to claim 1, wherein said lifeline is self-retracting.

3. A safety system for preventing falling injury from a working crane according to claim 2, wherein said working crane is a top running single girder crane having two sides; and wherein said tracks are attached to each side of the single girder.

4. A safety system for preventing falling injury from a working crane according to claim 3, further comprising:

a second fall transmitter; and wherein said second fall transmitter must be activated before said first fall transmitter can move said working crane.

5. A safety system for preventing falling injury from a working crane according to claim 2, wherein said working crane is a top running double girder crane connected to a lower girder flange; and wherein said tracks are attached to said top running double girder and to said lower girder flange.

6. A safety system for preventing falling injury from a working crane according to claim 5, further comprising:

a second fall transmitter; and wherein said second fall transmitter must be activated before said first fall transmitter can move said working crane.

7. A safety system for preventing falling injury from a working crane according to claim 2, further comprising:

a top running double girder attached to each of two said tracks; and wherein said working crane is a top running double girder crane; and wherein said tracks are attached to each girder of said top running double girder crane.

8. A safety system for preventing falling injury from a working crane according to claim 7, further comprising:

a second fall transmitter; and wherein said second fall transmitter must be activated before said first fall transmitter can move said working crane.

9. A safety system for preventing falling injury from a working crane according to claim 2, further comprising:

an under running single girder disposed on either side of two said tracks; and wherein said working crane is an under running single girder crane having two sides; and wherein said tracks are attached on each side of said under running single girder.

10. A safety system for preventing falling injury from a working crane according to claim 9, further comprising:

a second fall transmitter; and wherein said second fall transmitter must be activated before said first fall transmitter can move said working crane.

11. A safety system for preventing falling injury from a working crane according to claim 2, further comprising:

a second fall transmitter; and wherein said second fall transmitter must be activated before said first fall transmitter can move said working crane.

12. A safety system for preventing falling injury from a working crane according to claim 1, wherein said working crane is a top running single girder crane having two sides; and wherein said tracks are attached to each side of the single girder.

13. A safety system for preventing falling injury from a working crane according to claim 12, further comprising:

a second fall transmitter; and wherein said second fall transmitter must be activated before said first fall transmitter can move said working crane.

14. A safety system for preventing falling injury from a working crane according to claim 1, wherein said working crane is a top running double girder crane connected to a lower girder flange; and wherein said tracks are attached to said top running double girder and to said lower girder flange.

15. A safety system for preventing falling injury from a working crane according to claim 14, further comprising:

a second fall transmitter; and wherein said second fall transmitter must be activated before said first fall transmitter can move said working crane.

16. A safety system for preventing falling injury from a working crane according to claim 1, further comprising:

a top running double girder attached to each of two said tracks; and wherein said working crane is a top running double girder crane; and wherein said tracks are attached to each girder of said top running double girder crane.

17. A safety system for preventing falling injury from a working crane according to claim 16, further comprising:

a second fall transmitter; and wherein said second fall transmitter must be activated before said first fall transmitter can move said working crane.

18. A safety system for preventing falling injury from a working crane according to claim 1, further comprising:

an under running single girder disposed on either side of two said tracks; and wherein said working crane is an under running single girder crane having two sides; and wherein said tracks are attached on each side of said under running single girder.

19. A safety system for preventing falling injury from a working crane according to claim 18, further comprising:

a second fall transmitter; and wherein said second fall transmitter must be activated before said first fall transmitter can move said working crane.

20. A safety system for preventing falling injury from a working crane according to claim 1, further comprising:

a second fall transmitter; and wherein said second fall transmitter must be activated before said first fall transmitter can move said working crane.

21. A safety system for preventing falling injury from a working crane when an operator is operating said working crane from the floor, comprising the steps of:

providing said operator with a floor transmitter;

inserting a master key into said floor transmitter by said operator;

selecting of a function for said working crane by said operator; and selecting of a speed by said operator.

22. A safety system for preventing falling injury from a working crane when an operator is operating said working crane from above the floor, comprising the steps of:

providing said operator with a fall transmitter;

inserting a master key into said fall transmitter by said operator;

selecting of a function for said working crane by said operator; and selecting of a speed by said operator.

23. A safety system for preventing falling injury from a working crane when two operators are operating said working crane from above the floor, comprising the steps of:

providing first said operator with a main fall transmitter;

providing second said operator with a secondary fall transmitter in fall mode;

inserting a master key into said main fall transmitter by said first operator;

activating said secondary fall transmitter by pressing and holding a push button by said second operator;

selecting of a function for said working crane by said first operator; and selecting of a speed by said first operator.

* * * * *